US009290033B2

(12) United States Patent
Russell et al.

(10) Patent No.: US 9,290,033 B2
(45) Date of Patent: Mar. 22, 2016

(54) FILE FOLDER WITH MULTIPLE POCKETS

(71) Applicant: Smead Manufacturing Company, Hastings, MN (US)

(72) Inventors: James Russell, Hastings, MN (US); Daniel Seleski, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 14/513,505

(22) Filed: Oct. 14, 2014

(65) Prior Publication Data

US 2015/0102092 A1 Apr. 16, 2015

Related U.S. Application Data

(60) Provisional application No. 61/891,123, filed on Oct. 15, 2013.

(51) Int. Cl.

| | |
|---|---|
| ***B65D 27/00*** | (2006.01) |
| ***B42F 7/06*** | (2006.01) |
| ***B31B 49/04*** | (2006.01) |

(52) U.S. Cl.
CPC . *B42F 7/06* (2013.01); *B31B 49/04* (2013.01); *B31B 2219/147* (2013.01)

(58) Field of Classification Search
CPC ..... B32F 7/06
USPC ..... 229/67.1–67.4, 72
See application file for complete search history.

(56) References Cited

U.S. PATENT DOCUMENTS

| | | | | |
|---|---|---|---|---|
| 304,845 | A | 9/1884 | Moss | |
| 3,186,629 | A * | 6/1965 | Tucker | 229/72 |
| 3,858,790 | A | 1/1975 | Humphrey | |
| 4,301,962 | A | 11/1981 | Monckton et al. | |
| D267,152 | S | 12/1982 | Nerlinger, Jr. | |
| D308,887 | S | 6/1990 | Wyant | |
| D312,275 | S | 11/1990 | Wyant | |
| 4,989,777 | A | 2/1991 | Miller | |
| D432,166 | S | 10/2000 | Matheson | |
| D440,253 | S | 4/2001 | Wolff et al. | |
| 6,382,864 | B1 | 5/2002 | Moor | |
| 6,453,589 | B1 | 9/2002 | Schwartz | |
| D474,966 | S | 5/2003 | Schrem et al. | |
| 6,578,756 | B2 | 6/2003 | Marumi | |
| 7,108,169 | B2 | 9/2006 | Balzer | |
| 7,306,134 | B1 * | 12/2007 | Ong | 229/67.1 |
| 8,152,050 | B2 * | 4/2012 | Busam et al. | 229/67.1 |
| 8,162,204 | B2 | 4/2012 | Makofsky | |
| 8,256,662 | B2 * | 9/2012 | Grassia et al. | 229/67.1 |
| 8,684,259 | B2 | 4/2014 | Makofsky et al. | |
| 2003/0010815 | A1 | 1/2003 | Balzer | |
| 2004/0066031 | A1 | 4/2004 | Wong et al. | |
| 2004/0245324 | A1 | 12/2004 | Chen | |
| 2005/0127148 | A1 | 6/2005 | Gecha | |

(Continued)

*Primary Examiner* — Jes F Pascua
(74) *Attorney, Agent, or Firm* — Altera Law Group, LLC

(57) ABSTRACT

A file folder with multiple pockets and a method of making is disclosed. Cover panels (16,18) are joined along a central axis (11), at least one primary pocket is formed with a pocket panel (18*a*), a second pocket panel (40) is located in a primary pocket space (24) thereby subdividing the pocket space into a first pocket space between the first pocket panel and the second pocket panel and a second pocket space between the second pocket panel and one of the cover panels, the second pocket panel (40) includes an extension (50) which is folded over and affixed to the first pocket panel thereby forming a closed inner edge on the front pocket.

13 Claims, 7 Drawing Sheets

(56) References Cited

U.S. PATENT DOCUMENTS

| | | | |
|---|---|---|---|
| 2005/0156017 | A1 | 7/2005 | Crum et al. |
| 2006/0055167 | A1 | 3/2006 | Pollman et al. |
| 2006/0060641 | A1 | 3/2006 | Taylor |
| 2006/0081689 | A1 | 4/2006 | Sierra |
| 2006/0202002 | A1 | 9/2006 | Retucci |
| 2007/0085327 | A1 | 4/2007 | Russo |
| 2008/0197174 | A1 | 8/2008 | Wittmeyer et al. |
| 2008/0257940 | A1 | 10/2008 | Busam et al. |
| 2009/0114704 | A1 | 5/2009 | Howlett |
| 2011/0084119 | A1 | 4/2011 | Zapalac |
| 2013/0146648 | A1 | 6/2013 | Snelling |
| 2013/0320074 | A1* | 12/2013 | Leonard ..... 229/67.1 |
| 2014/0001246 | A1 | 1/2014 | Makofsky et al. |

* cited by examiner

FILE FOLDER WITH MULTIPLE POCKETS

CROSS-REFERENCE TO RELATED APPLICATIONS

This application claims priority of U.S. patent application Ser. No. 13/484,717 filed 31 May 2012 entitled: High Capacity Pocket File Folder and U.S. patent application Ser. No. 29/423,397 filed 31 May 2012 entitled Pocket Folder, both of which are herein incorporated by reference in their entireties.

BACKGROUND

1. Field of the Disclosure

The present disclosure of the invention is directed to file folders and more particularly to pocket style file folders with the ability to divide folder contents into sub-pockets.

2. Description of the Related Art

Pocket folders are typically characterized by having two leaves or side panels, joined longitudinally on a fold line and one or more of the panels having a pocket. One of the first examples of such a product is found in U.S. Pat. No. 304,845 to Moss (1884). A later embodiment is found in U.S. Design No. Des. 312275 to Wyant (1990). A further example is US Publication No. US2004/0066031 to Wong (2004).

The utility of pocket folders can be increased by increasing the number of pockets which the folder contains, but it is important that the pockets be closed on their exterior edge to prevent items from falling out. An example of a complex solution to the general problem of multi pocket folders is shown in U.S. Pat. No. 8,256,662 to Grassia et al. but it does not have edge-integrity on its outer peripheral edge 639, which allows items to fall out. This weakness erodes the utility of such a structure. Furthermore, it requires additional paper resources and manufacturing steps to be manufacturable thus increasing the cost.

Therefore there is a need for a multi pocket folder which can be constructed and manufactured with fewer materials and construction steps to lower the cost of manufacture and has edge-integrity to prevent loss of materials in the pockets.

The present disclosure addresses both of these problems with an innovative solution.

BRIEF SUMMARY OF THE INVENTION

The following summary is intended to assist the reader in understanding the full disclosure and the claims. The claims define the scope of the invention, not this summary.

The disclosure includes a document holder (aka folder) having a first and second cover panels, each having a lateral and a longitudinal extent, upper, bottom, inner and outer peripheral edges, said first and second panels being joined together along their inner edges at a joint and defining a central fold axis; each of said first cover and said second cover, at least one of the cover panels including a primary pocket, said primary pocket including a first pocket panel and the primary pocket being formed between said cover panel and first pocket panel, said first pocket panel having a lateral extent less than the lateral extent of one of the cover panels, said first pocket being joined to said cover panel at said bottom and said outer peripheral edges thereby forming a pocket space wherein said first pocket panel has a free inner edge adjacent said central axis and a free upper edge. The term "free edge" means, for example, that it is not connected to another part of folder at that edge.

A second pocket panel having a lateral extent generally equal to or greater than the lateral extent of said first pocket panel, said second pocket panel being located in the primary pocket space thereby subdividing said pocket space into a first pocket space between said first pocket panel and said second pocket panel and a second pocket space between said second pocket panel and one of said cover panels.

Said second pocket panel including an extension at an end adjacent said central axis, said extension being folded over and affixed to said first pocket panel thereby forming a closed inner edge on said front pocket. In the alternative the extension can be affixed to the cover panel, or the extension can be part of panel 18*a* as extension 30*b* as shown in FIG. 3. So when referring to the extension of the second pocket panel in the claims, the intention is to include all of these options by such terminology.

The folder further includes a cover tab extending from the outer peripheral edge of one of said cover panels and wherein said tab extension is folded on and affixed to said first pocket panel at its outer peripheral edge thereby creating a closed outer peripheral edge between said front pocket panel and one of said cover panels.

A third pocket panel having a lateral extent generally equal to said second pocket panel and being located in the second pocket space thereby subdividing said second pocket space into a second pocket space between said second pocket panel and said third pocket panel creating third pocket space between said third pocket panel and one of said cover panels.

The folder further wherein said second and third pocket panels are unattached at their distal ends adjacent said outer peripheral edge.

The folder further includes a second pocket panel having a central edge and a distal edge, said central edge including a foldable tab bendable to be affixed to said first pocket panel.

The folder further includes a third pocket panel having a central edge and a distal edge, said central edge including a foldable tab bendable to be affixed to said first pocket panel.

The folder of above, wherein said second pocket panel has a diagonal cut corner adjacent its distal lower edge.

The folder of above wherein said second pocket panel includes an extension at an end adjacent said central axis, said extension being folded over and affixed to one of said cover pockets thereby forming a closed inner edge on said front pocket.

The folder of above further including a paper retainer extending from a top edge of both cover panels along said axis and wherein said lock member is foldable onto to said cover panels to create an upper paper retainer.

The folder of above wherein said pocket panels include a circular edge recess adjacent to the upper edge and extending to said central axis.

The disclosure also includes a further retainer flap foldably attached at the upper edge of each cover leaf, said flap spanning said covers but not being connected at the joint and, when in its unfolded state, forming an aperture bounded by the flap and the upper edges of the covers, said flap having a central fold line co-axially aligned with said central axis and further including a plurality of parallel scored fold lines on either central fold line.

The disclosure also includes a semi-circular or circular concave cut away edge extending from the upper edge of the angular shaped notch on each pocket face to the upper edge of the pocket face. The semi-circular edges of the pocket faces together forming an extension generally have circle cut out spanning the pocket faces, with a v-shaped central base at the semicircle.

The disclosure also includes a retainer flap which is formed as a semi-circular element having semi-circular inner and outer peripheral edges.

Also disclosed is a folder having any or all of the following elements:

a first and second cover panels, each having a lateral and a longitudinal extent, upper, bottom, inner and outer peripheral edges, said first and second panels being joined together along their inner edges at a joint and defining a central fold axis; each of said first cover and said second cover, at least one of the cover panels including a primary pocket, said primary pocket including a first pocket panel and the primary pocket being formed between said cover panel and first pocket panel, said first pocket panel having a lateral extent less than the lateral extent of one of the cover panels, said first pocket being joined to said cover panel at said bottom and said outer peripheral edges thereby forming a pocket space;

wherein said first pocket panel has a free inner edge adjacent said central axis and a free upper edge;

a second pocket panel having a lateral extent generally equal to or greater than the lateral extent of said first pocket panel, said second pocket panel and being located in the primary pocket space thereby subdividing said pocket space into a first pocket space between said first pocket panel and said second pocket panel and a second pocket space between said second pocket panel and one of said cover panels;

said first pocket panel including an extension at an end adjacent said central axis, said extension being folded over and affixed to said second pocket panel thereby forming a closed inner edge on said front pocket.

The disclosure also includes a method of forming multi-pocket folder from a blank for folding into a pocket folder by creating and scoring a blank sheet with the following, using some or all of these steps in any order:

A. cutting and scoring a first blank having;

1. left and right cover panels joined at a central axis, each panel having a lower edge;
2. cutting the blank to form a first panel extension at least one lower edge; said panel extension including a side tab and having a predetermined longitudinal dimension; thereby forming a first pocket space;
3. folding said first panel extension against one of said cover panels and folding and affixing said tab on said cover panel to create a first pocket;

B. cutting a second blank having a longitudinal dimension generally equal to or less than the longitudinal dimension of said first panel extension and including a foldable side tab;

C. inserting second blank into said first pocket space thereby subdividing said space;

D. affixing said foldable side tab to said panel extension;

so that the first pocket space is divided into first and second pocket spaces by said second blank, thereby forming a multi-pocket folder.

A method is also disclosed for making a folder from a blank for folding into a pocket folder by creating and scoring a blank sheet with the following, comprising any or all of the following steps of, in any order:

a. cutting and scoring a first blank having;

1. left and right cover panels joined at a central axis, each panel having a lower edge;
2. cutting the blank to form a first panel extension at least one lower edge; said panel extension including a side tab and having a predetermined longitudinal dimension; thereby forming a first pocket space;
3. folding said first panel extension against one of said cover panels and folding and affixing said tab on said cover panel to create a first pocket;

b. cutting a second blank having a longitudinal dimension generally equal to or less than the longitudinal dimension of said first panel extension and including a foldable side tab;

c. inserting second blank into said first pocket space thereby subdividing said space;

d. joining the free edge of said second blank to said panel extension where adjacent the central axis;

so that the first pocket space is divided into first and second pocket spaces by said second blank, thereby forming a multi-pocket folder.

DETAILED DESCRIPTION OF THE DISCLOSURE

The present description shows pocket folder 10. It should be understood that the term pocket holder includes any form of document holder which has at least two faces, each having a pocket which are joined together by a central longitudinal fold line/axis or joint 11.

Figure 1:
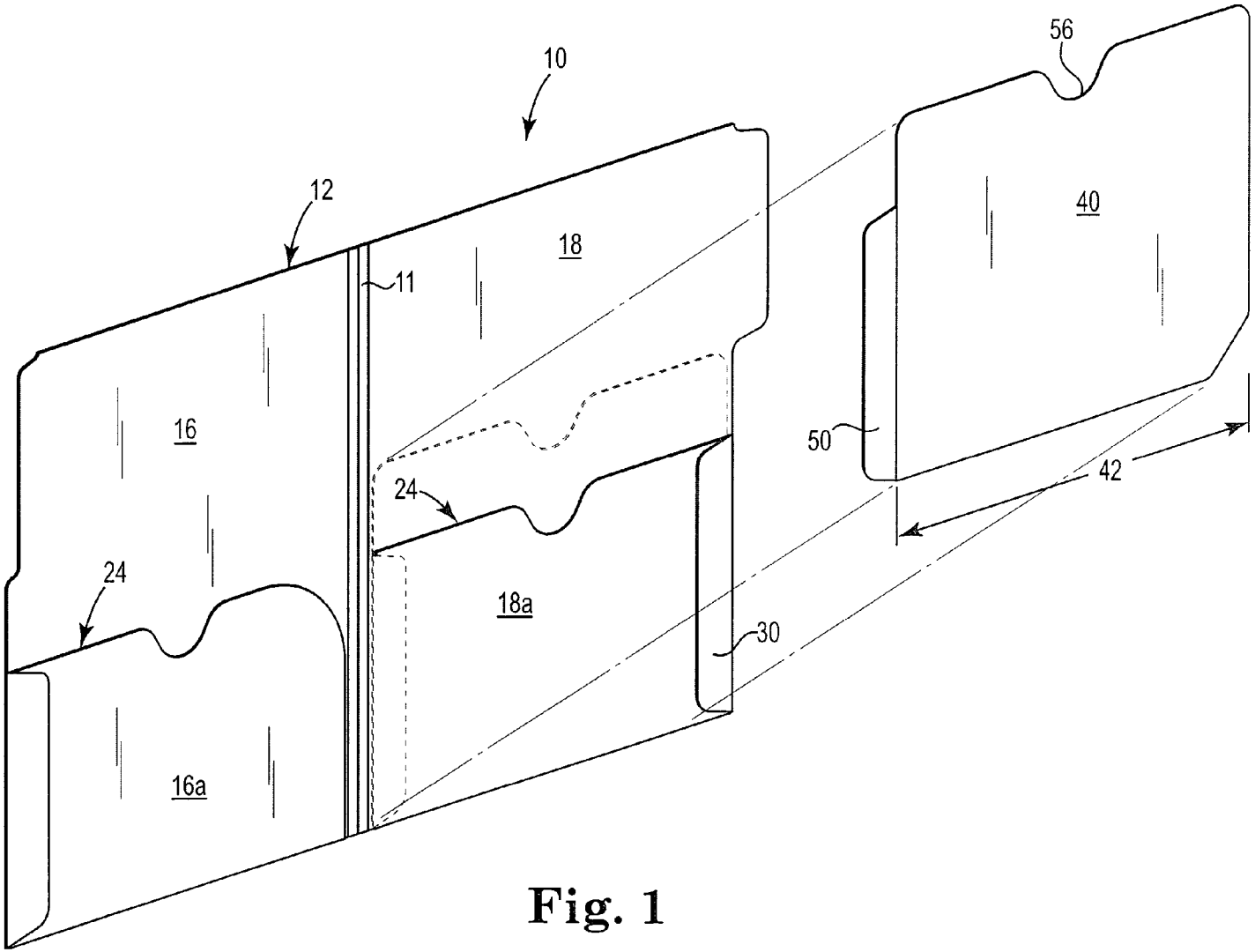
FIG. 1 illustrates an inside perspective view of one embodiment with an insert panel removed with its placement shown in broken lines.
Figure 2:
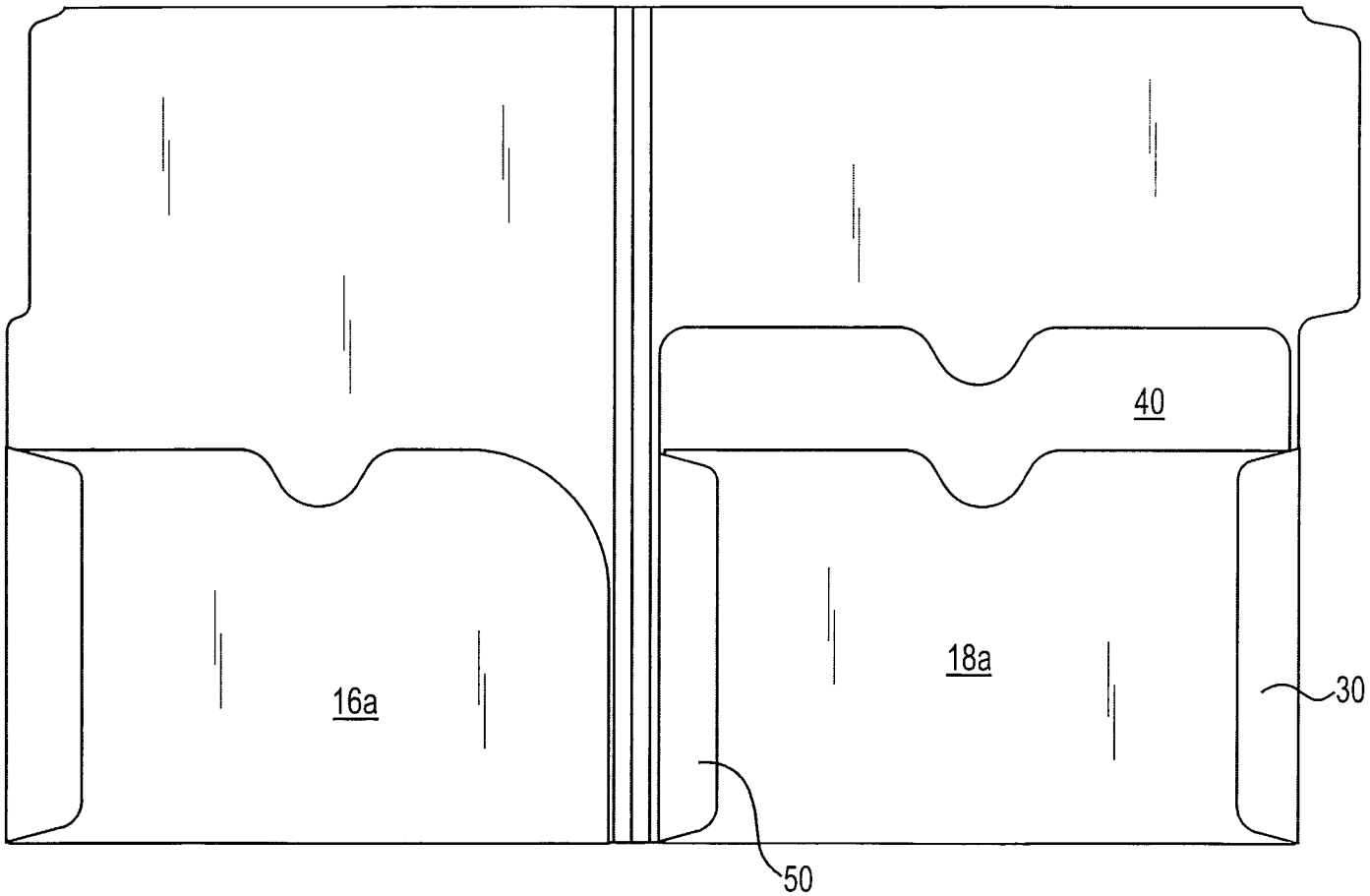
FIG. 2 illustrates a front plan view of the embodiment in FIG. 1 assembled.
Figure 3:
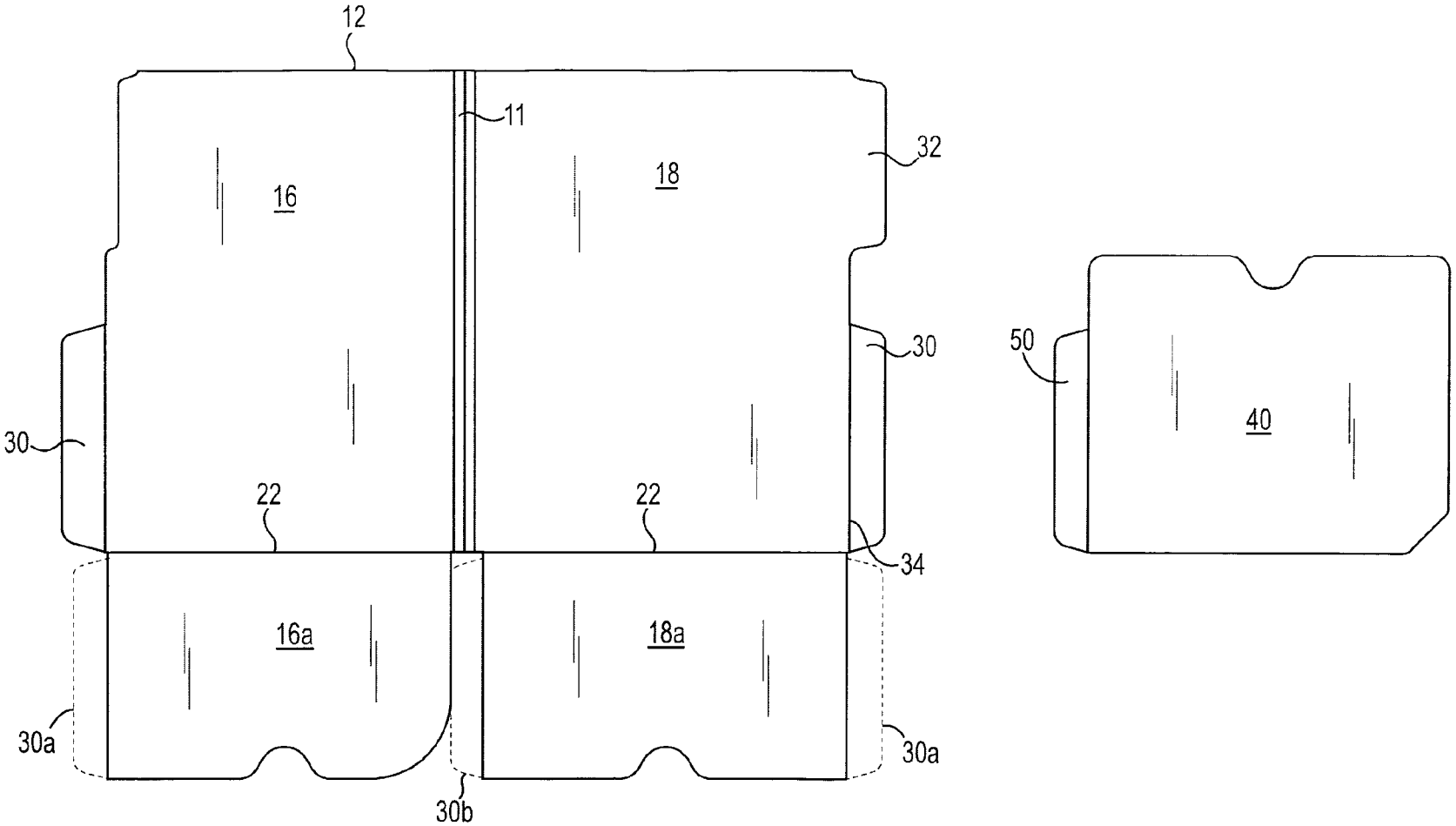
FIG. 3 illustrates a top plan view of a pair of blanks cut to conform to the embodiment in FIG. 1.
Figure 4:
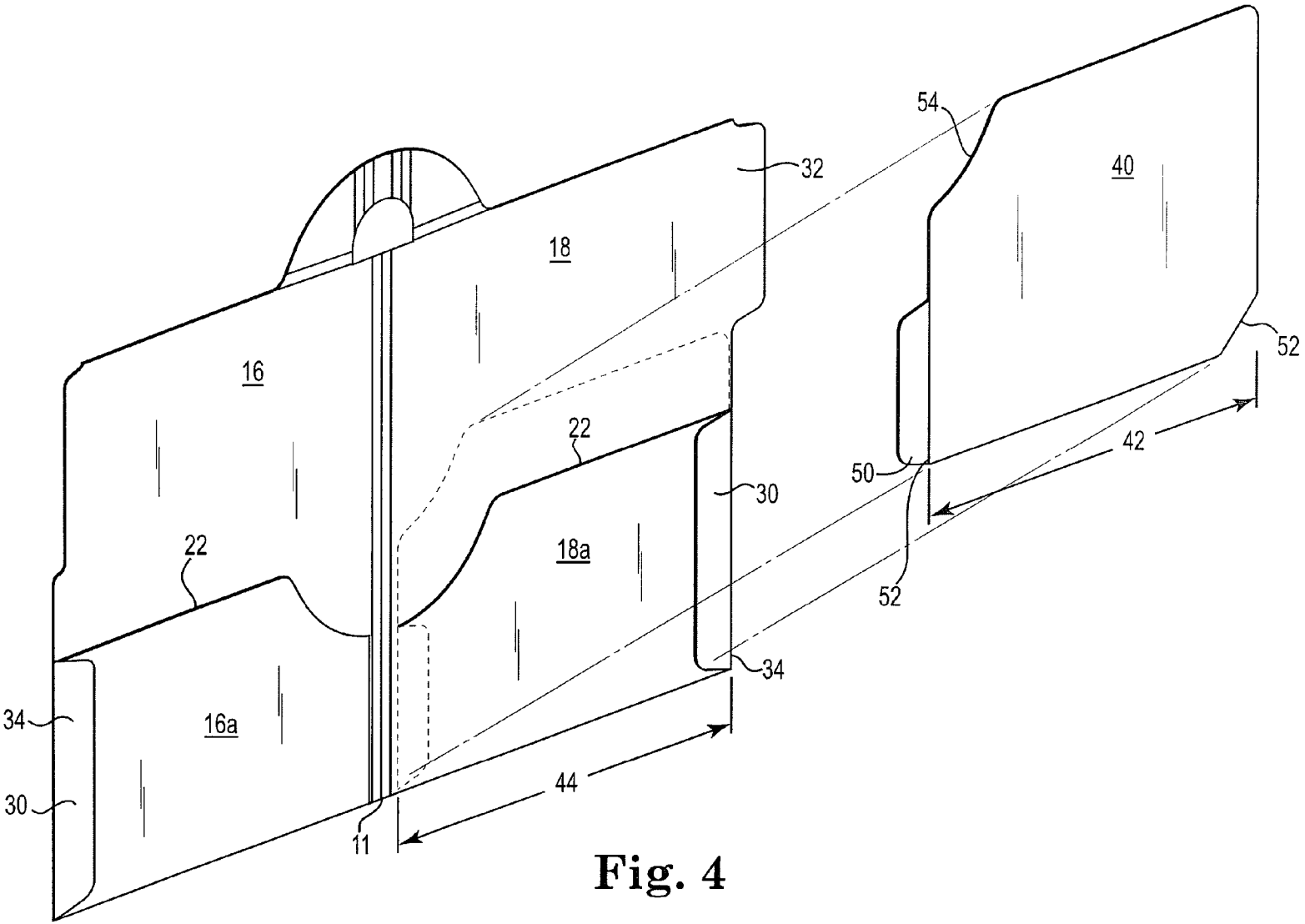
FIG. 4 illustrates a front perspective view like FIG. 1 but with a paper retainer and sculpted panels.

In the embodiment shown in FIGS. 1-3 folder 10 is preferably made of a blank of materials, often a double or triple weight board material or synthetic such as plastic. In the method as described below, various cuts and folds are made in the blank to achieve the desired features.

The blank 12 is shown after cutting portions away as shown in FIG. 1. The blank includes a first cover panel 16 and a second cover 18 each having extension panels 16*a*, 18*a* which extent from the blank at a score line 22. Notes: the preferred embodiment has twin pockets either side of a central axis. A single pocket version, either side, is to be considered an equivalent but the dual pocket version will be discussed.

The extension panels 16*a*/18*a* are to be folded along the fold line 22 to form first pocket space 24 between the cover panels 16/18 and the extension panels 16*a*/18*a*. The height of panels 16*a*/18*a* are predetermined according to user desire, typically one third to one half of the height of the cover panels.

Cover panels 16/18 may include tabs 30, 32 which have different functions. Tab 32 is an indicator tab for written indicia, whereas tab 30 is to be folded along a score line 34 to retain panels 16*a*/18*a*. Note: however that this tab 30 may be optionally placed on covers 16*a*/18*a* as shown in broken lines 30*a*. When referring to the attachment of cover panels to covers in the claims, it shall be assumed that these are interchangeable equivalents.

In order to make a multi pocket file, a blank is cut to the shape of the second or insert panel 40. Panel 40 has a lateral dimension 42 which is less that the lateral dimension 44 which is from the central axis 11 to the outer peripheral edge of the cover panel. This limitation prevents the insert panel from being damaged when the covers are folded together.

Figure 5:
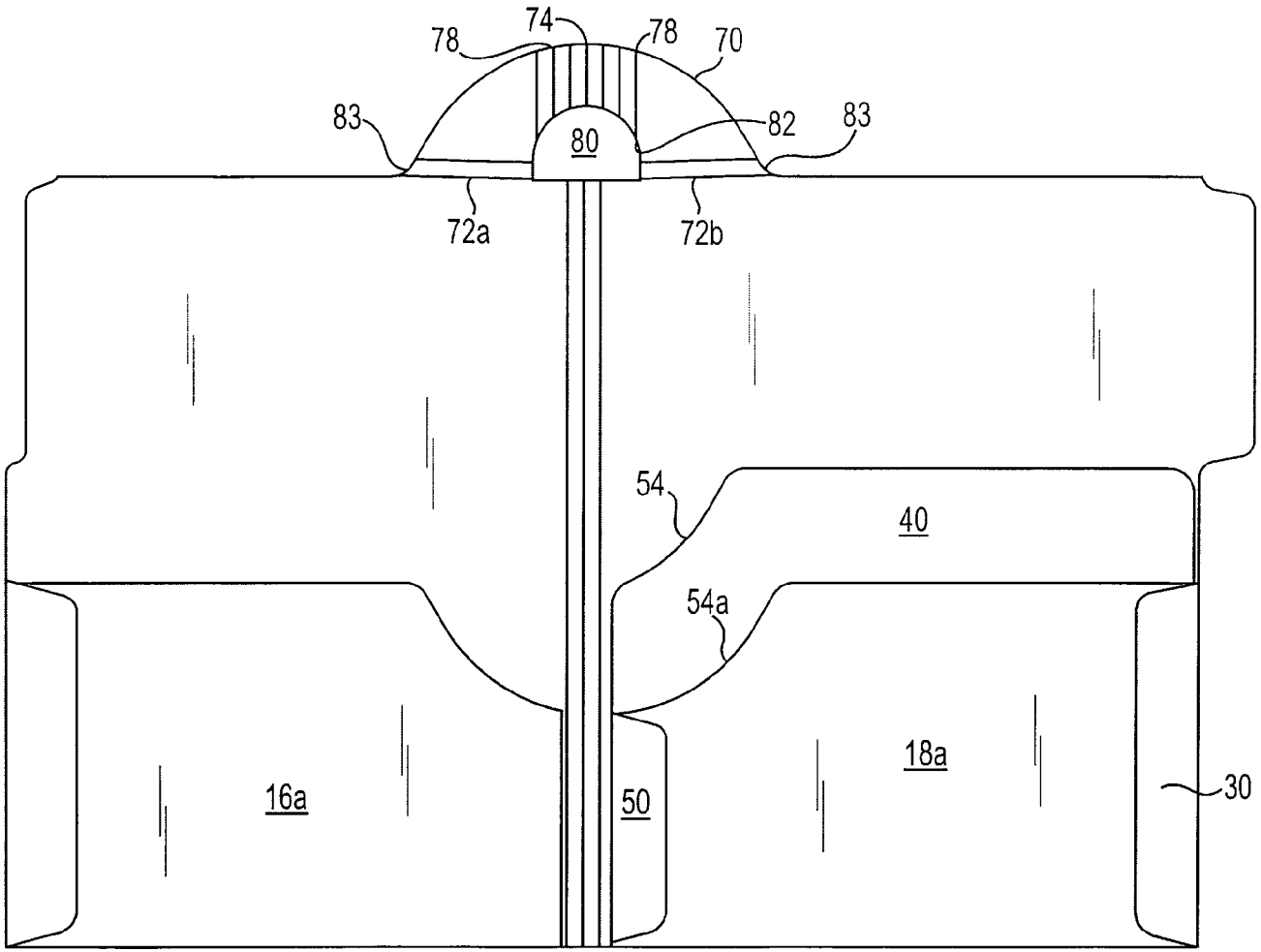
FIG. 5 illustrates a front plan view of the embodiment in FIG. 4 assembled.

This dimensional measurement 42 does not include tab 50 which extends from the panel at score line 52 and provides a means for attachment of the insert panel to either the adjacent cover panel or the adjacent extension panel. The preferred embodiment is shown in FIGS. 2 and 5 where tab 50 is folded forward and affixed to the insert panel but either way should be considered equivalents in the claims.

Figure 6A:
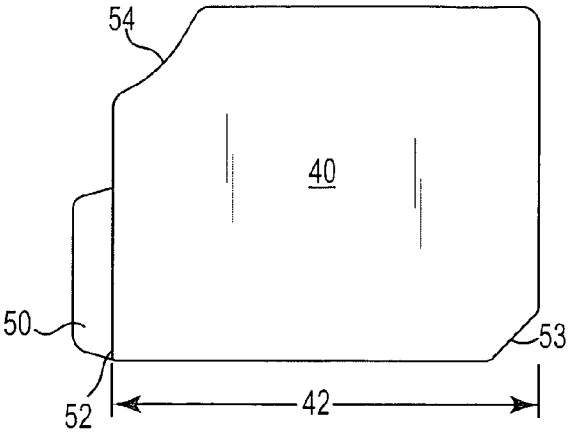
FIG. 6*a* illustrates plan view of an insert panel for the folder in FIG. 6.
Figure 6B:
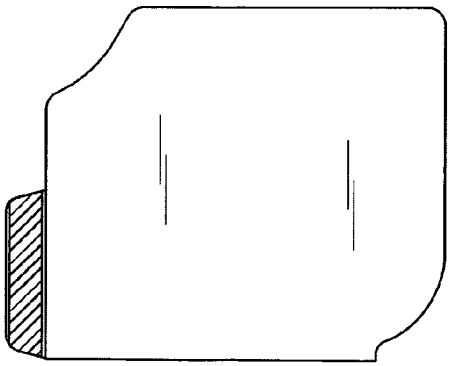
FIG. 6*b* a variant of FIG. 6*a* which illustrates plan view of an alternate insert panel for the folder similar to that shown in FIG. 7*a*.
Figure 6:
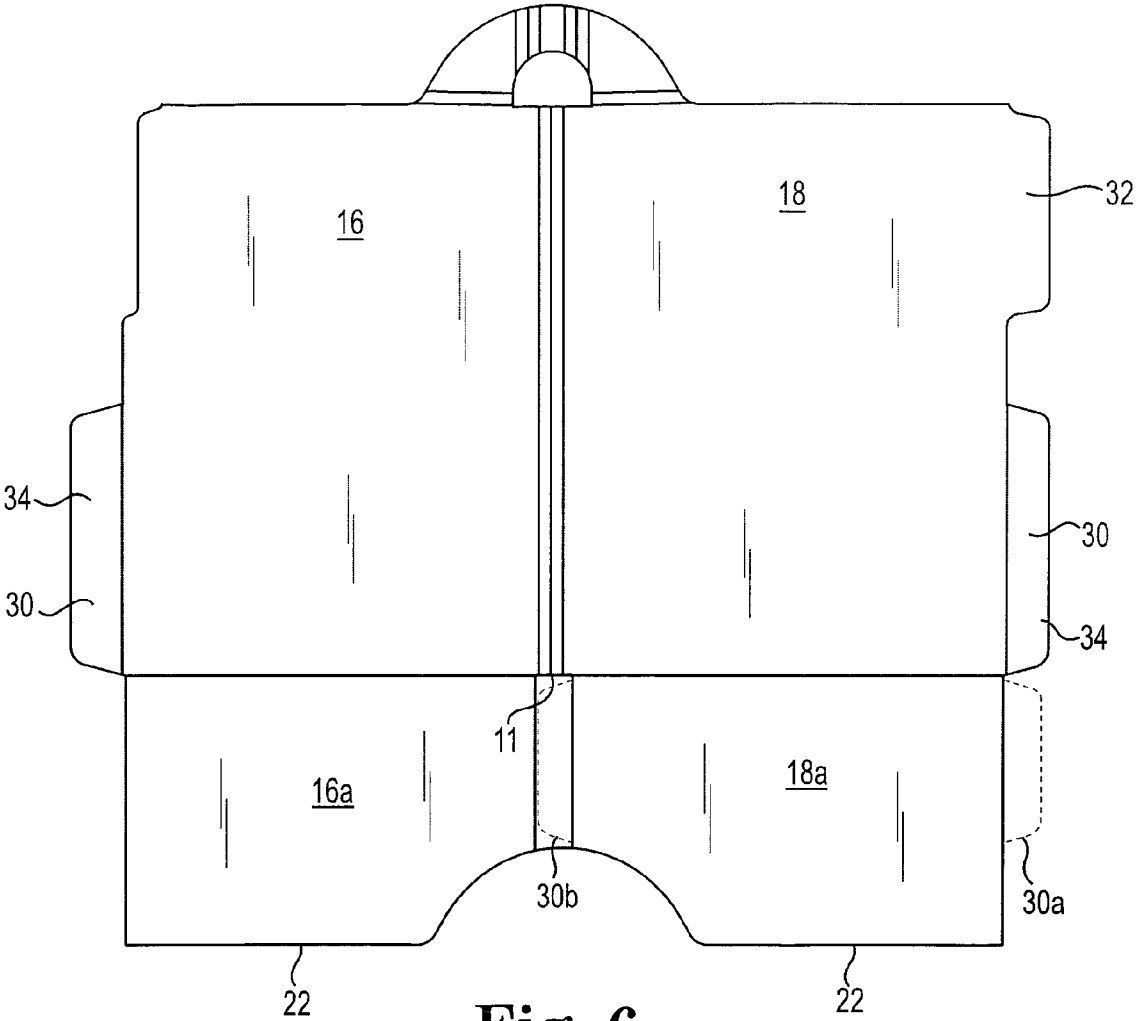
FIG. 6 illustrates a top plan of the blanks cut to conform to the embodiment in FIG. 4.
Figure 7A:
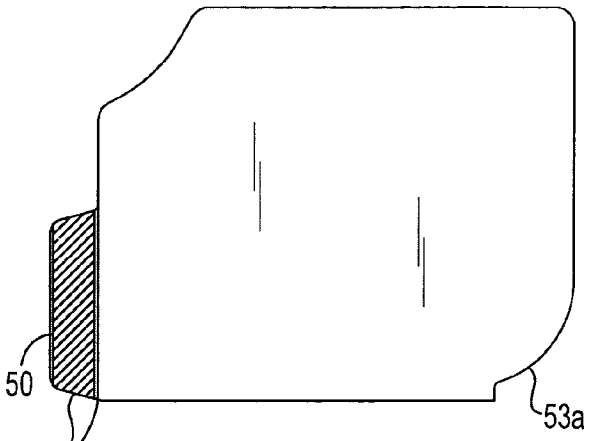
FIG. 7*a* illustrates plan view of an alternate insert panel for the folder in FIG. 7.
Figure 7:
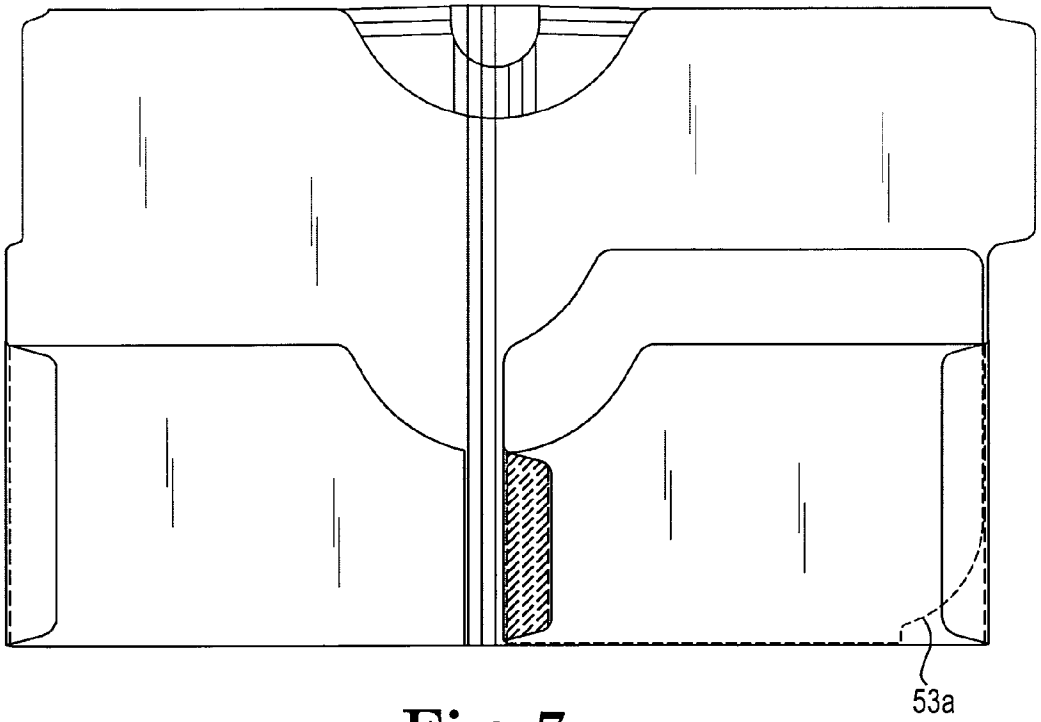
FIG. 7 is a view like FIG. 6 except with an alternate insert panel.

Panel 40 therefor preferably has a dimension 42 less than or equal to dimension 44, a truncated corner 53, where the corner is cut diagonally to permit easy insertion into the pocket space 24. Likewise the upper left corner 54 (diagonally opposite of corner 53 is truncated, preferably in a concave arcuate path. Panel 40 may also include an index cut 56 as shown in FIG. 1. Panel 40 preferably has a height dimension great than that of extension panel 16*a*/18*a* as shown in FIG. 1 in broken lines. The greater height allows the insert panel to be more easily seen though it may also be the same or lower than the height of the associated extension panel. The extension panel 16*a*/18*a* may also include an arcuate cut 54*a*. FIGS. 6*a* and 7 are similar except that the truncated corner 53*a* in FIG. 7*a* follows an arcuate path until proximate the lower horizontal edge where it follows a vertical path as shown.

Insert panel 40 effectively divides the pocket space 24 into two spaces on either side of panel 40.

Any number of insert panels may be inserted behind panel 40 further subdividing the space into additional pocket spaces.

To assist in holding documents in the pockets, a top flap/retainer 70 is formed at top score line 72*a*-72*b* which runs along the top edge 18*a*-18*b*. Additional details of this feature can be seen in U.S. patent Ser. No. 13/484,717 filed 13 May 2012 entitled High Capacity Pocket File Folder, which is herein incorporated by reference in its entirety.

At the intersection of retainer 70 with the top edge, the retainer is radiused at 83 where the flap "flows" into the top edge so that there is no sharp intersection points or corners to provide a tear point and undue stress on the fibers of the material. Likewise, score line 72*a*-72*b* must preferably pass entirely through the intersection between the top tab and the top surfaces so that the material fibers are less likely to tear. In fact, the score line compresses the fibers and gives them additional strength at a high stress point.

Flap 70 also includes a main score line 74 which is co-axial with fold line 30 so that when the folder is folded, the top flap also folds symmetrically along line 74. To accommodate documents of varying thicknesses, top flap 70 preferably includes a plurality of parallel spaced apart score lines 78 which assist the flap in bending to accommodate additional thicknesses without buckling.

Likewise, in one embodiment, a portion of the top flap 70 is cut away to reveal an aperture 80 which is bounded on one edge by the top edges of the cover panels and on the semicircular inner edge 82 of the tab. The inner edge 82 may be other shapes besides circular, such as a v-cut or diamond shaped. The outer edge 84 of the top tab is also shown as circular but it too may be other shapes such a triangular, v-shaped, rectangular, etc.

The extension panels may also be cut away as described in U.S. patent Ser. No. 13/484,717 to have an expansion notch/corner 53 therein.

This disclosure also includes a method of manufacture or assembly of a multi-pocket folder from a blank for folding into a pocket folder. The preferred method is by creating and scoring a blank sheet with the following, using some or all of these steps in any order:

A. cutting and scoring a first blank having;

1. left and right cover panels joined at a central axis, each panel having a lower edge;
2. cutting the blank to form a first panel extension at least one lower edge; said panel extension including a side tab and having a predetermined longitudinal dimension. It is also possible to form the tab on the left or right panel in the alternative, which should be considered equivalents. Either way a first pocket space is formed.
3. folding said first panel extension against one of said cover panels and folding and affixing said tab on said cover panel to create a first pocket;

B. cutting a second blank, which will become the insert panel, having a longitudinal dimension generally equal to or less than the longitudinal dimension of said first panel extension and including a foldable side tab;

C. inserting second blank insert into said first pocket space thereby subdividing the pocket space into two pocket spaces. For additional pocket spaces, additional inserts can be used;

D. affixing said foldable side tab to said panel extension or joining the free edge of said second blank to said panel extension where adjacent the central axis;

so that the first pocket space is divided into first and second pocket spaces by said second blank, thereby forming a multipocket folder.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A folder comprising:

a first and second cover panels, each having a lateral and a longitudinal extent, upper, bottom, inner and outer peripheral edges, said first and second panels being joined together along their inner edges at a joint and defining a central fold axis; each of said first cover and said second cover, at least one of the cover panels including a primary pocket, said primary pocket including a first pocket panel and the primary pocket being formed between said cover panel and first pocket panel, said first pocket panel having a lateral extent less than the lateral extent of one of the cover panels, said first pocket being joined to said cover panel at said bottom and said outer peripheral edges thereby forming a pocket space;

wherein said first pocket panel has a free inner edge adjacent said central axis and a free upper edge;

a second pocket panel having a lateral extent generally equal to or greater than the lateral extent of said first pocket panel, said second pocket panel and being located in the primary pocket space extending immediately adjacent said outer peripheral edge of said first pocket thereby fully subdividing said pocket space into a first pocket space between said first pocket panel and said second pocket panel and a second pocket space between said second pocket panel and one of said cover panels;

said second pocket panel having a lower edge and first and second side edges, and including an extension from said first edge at an end adjacent said central axis, said extension being folded over and affixed to said first pocket panel thereby forming a closed inner edge on said front pocket; said second pocket panel further including a lower corner adjacent said outer peripheral edge, and wherein said corner is a truncated diagonal corner formed along a diagonal line joining said second side edge and bottom edge.

2. The folder according to claim 1 further including a cover tab extending from the outer peripheral edge of one of said cover panels and wherein said tab extension is folded on and affixed to said first pocket panel at its outer peripheral edge thereby creating a closed outer peripheral edge between said front pocket panel and one of said cover panels.

3. The folder of claim 1, wherein said second pocket panel is unattached at their distal ends adjacent said outer peripheral edge.

4. The folder of claim 1 further including a second pocket panel having a central edge and a distal edge, said central edge including a foldable tab bendable to be affixed to said first pocket panel.

5. The folder of claim 1, wherein said second pocket panel has a diagonal cut corner adjacent said bottom edge and wherein corners defined by said cut corned are rounded.

6. The folder of claim 1, wherein said second pocket panel includes an extension at an end adjacent said central axis, said extension being folded over and affixed to one of said cover panels thereby forming a closed inner edge on said front pocket.

7. The folder of claim 1 further including a paper retainer extending from a top edge of both cover panels along said axis and wherein said lock member is foldable onto to said cover panels to create an upper paper retainer.

8. The folder of claim 1, wherein said pocket panels include a circular edge recess adjacent their upper edge and extending to said central axis.

9. The folder of claim 1 further including a retainer flap foldably attached at the upper edge of each cover panel, said flap spanning said covers but not being connected at the joint and, when in its unfolded state, forming an aperture bounded by the flap and the upper edges of the covers, said flap having a central fold line co-axially aligned with said central axis and further including a plurality of parallel scored fold lines on either central fold line.

10. The folder of claim 1 further including a semi-circular cut away edge extending from the upper edge of the angular shaped notch on each pocket panel into the upper edge of the pocket panel, the semi-circular edge of the pocket panel together forming a generally have circle cut out formed between the pocket panel, with a v-shaped central base at the semicircle.

11. The folder of claim 1 including a retainer flap which is formed as a semi-circular element having a semi-circular inner and outer peripheral edges.

12. A folder comprising:

a first and second cover panels, each having a lateral and a longitudinal extent, upper, bottom, inner and outer peripheral edges;

said first and second panels being joined together along their inner edges at a joint and defining a central fold axis; each of said first cover and said second cover, at least one of the cover panels including a primary pocket, said primary pocket including a first pocket panel and the primary pocket being formed between said cover panel and first pocket panel, said first pocket panel having a lateral extent less than the lateral extent of one of the cover panels;

said first pocket being joined to said cover panel at said bottom and said outer peripheral edges thereby forming a pocket space;

wherein said first pocket panel has a free inner edge adjacent said central axis and a free upper edge;

a second pocket panel having a lateral extent generally equal to or greater than the lateral extent of said first pocket panel, said second pocket panel and being located in the primary pocket space thereby subdividing said pocket space into a first pocket space between said first pocket panel and said second pocket panel and a second pocket space between said second pocket panel and one of said cover panels;

said second pocket panel including an extension at an end adjacent said central axis, said extension being folded over and affixed to one of said cover panels thereby forming a closed inner edge on said front pocket; said second pocket panel further including a lower corner immediately adjacent said outer peripheral edge, and wherein said corner is a truncated diagonal corner formed along a diagonal line joining said second side edge and bottom edge.

13. A method of making a folder from a blank for folding into a pocket folder by creating and scoring a blank sheet with the following, comprising the steps of, in any order:

a. cutting and scoring a first blank having;

1. left and right cover panels joined at a central axis, each panel having a lower edge;
2. cutting the blank to form a first panel extension at least one lower edge; said panel extension including a side tab and having a predetermined longitudinal dimension; thereby forming a first pocket space;
3. folding said first panel extension against one of said cover panels and folding and affixing said tab on said cover panel to create a first pocket with an outer peripheral edge;

b. cutting a second blank having a longitudinal dimension generally equal to or less than the longitudinal dimension of said first panel extension and including a foldable side tab; cutting said second blank to created a diagonally truncated lower corner adjacent said outer peripheral edge:

c. inserting second blank into said first pocket space thereby subdividing said space with said second blank position immediately adjacent said outer peripheral edge;

d. affixing said foldable side tab to said panel extension so that the first pocket space is divided into first and second pocket spaces by said second blank, thereby forming a multi pocket folder.

* * * * *